United States Patent [19]

Hayashi

[11] Patent Number: 4,828,311

[45] Date of Patent: May 9, 1989

[54] METAL FORM PALLET

[76] Inventor: Isamu Hayashi, 101-12, Kamishiba, Oaza, Misato-machi, Gunma, gun, Gunma-Ken, Japan

[21] Appl. No.: 122,899

[22] Filed: Nov. 19, 1987

[30] Foreign Application Priority Data

Nov. 20, 1986 [JP] Japan ..... 61-177594

[51] Int. Cl.[4] ..... B66C 1/16

[52] U.S. Cl. ..... 294/67.3; 294/67.1

[58] Field of Search ..... 294/67.3, 67.1, 67.2, 294/67.4, 67.3; 414/277; 108/55.1, 55.3; 206/504, 503

[56] References Cited

U.S. PATENT DOCUMENTS 4,518,185 5/1985 Shiffer ..... 294/67.1

*Primary Examiner*—James B. Marbert

*Attorney, Agent, or Firm*—Curtis, Morris & Safford

[57] ABSTRACT

A pallet means for transporting a pile of metal forms having a pair of means spaced apart from each other and adapted to hold the opposite lateral ends of metal forms, each member of the pair respectively comprising a bottom beam arranged to hold a lower end of the metal forms, the bottom beam having locking means arranged to engage an interior surface of the metal form at the longitudinal end, and said beams mounted on each lateral end of the metal form to retain metal forms in rows and without slippage during transport.

1 Claim, 3 Drawing Sheets

METAL FORM PALLET

BACKGROUND OF THE INVENTION

1. Field of the Invention

This invention relates to a pallet' to transport ametal form for use in concrete placing.

2. Description of Prior Art

To transport a batch of concrete metal forms at one time, a box type container means is currently being used. As shown in FIG. 1, such a container means is built up by welding together L-shaped steel sections 1, 2, ...12. Any given number of metal forms are piled one above another, as for instance, in three rows as shown at 15, and are then conveyed by a crane or other lifting means by fastening wire ropes through hooks secured to the upper end of the container means.

Because of its one-piece box-type construction, there are problems in loading or unloading the metal forms by such a container means, which is very cumbersome due to upper beams 1, 3 obstructing the way. The container means also cannot accept metal forms with non-standard lengths. Further limitations are that when empty the container means is relatively heavy in itself and has a very large volume, and produces a problem of handling it on the work site, this results in deformation of the container means as well as a need for a large storage space when not in use. Thus, in practice, when a few pieces of metal forms are moved at a construction site, they are frequently carried by manpower by ignoring such container means, leading to ineffecient concrete placing work.

SUMMARY OF THE INVENTION

It is an object of this invention to provide a metal form pallet adapted to receive various size metal forms and easily and safely transport steel forms, thereby increasing the productivity of concrete placing work. The metal pallet of this invention requires a small storage space when not in use, while substantially free from deformation.

This invention features a pallet means for transporting a pile of metal forms having a pair of means spaced apart from each other for holding the opposite ends of metal forms, each member of said pair respectively comprising a bottom beam for holding a lower end of the metal forms; and side beams mounted on lateral ends of the metal forms for retention thereof, wherein the lower beam includes locking means for engaging an interior surface of each longitudinal end of the metal form.

DESCRIPTION OF THE PREFERRED EMBODIMENTS

Figure 1:
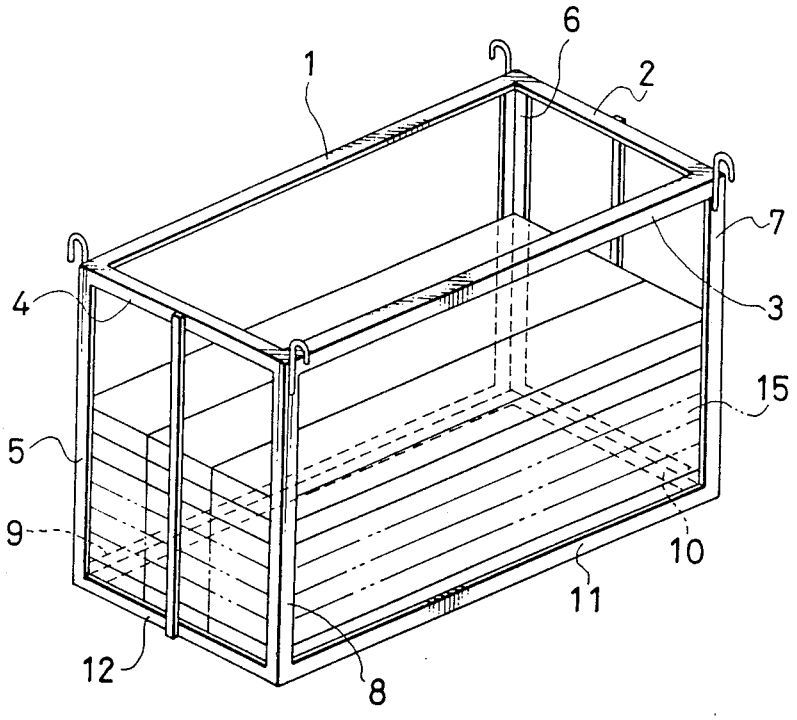
FIG. 1 is a perspective view of conventional container means.
Figure 2:
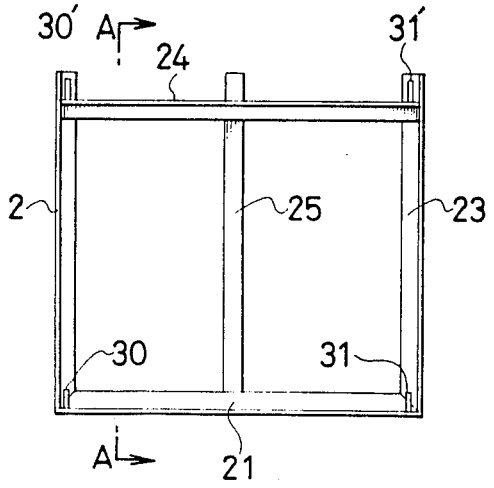
FIG. 2 is a front view showing a pallet means of one embodiment of the present invention.
Figure 3:
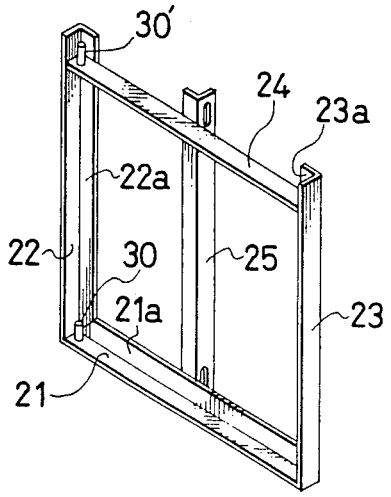
FIGS. 3 and 4 are perspective view corresponding to FIG. 2, but showing the pallet means from different directions.
Figure 4:
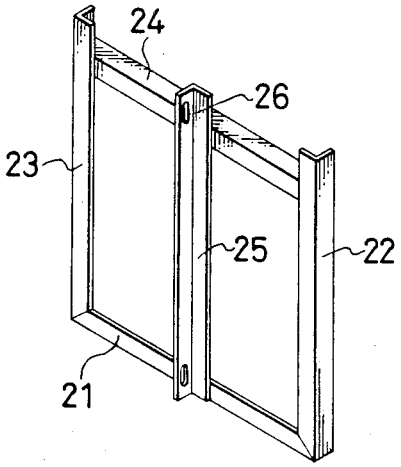
Figure 5:
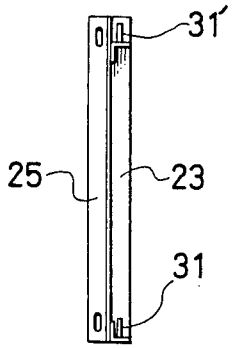
FIG. 5 is a sectional view taken on lines A—A of FIG. 2.

An embodiment of the present invention will now be described by reference to FIGS. 2 and 5.

As shown, a pair of pallet means of the present invention each comprises a bottom beam 21 and side beams 22, 23. Both the bottom beam 21 and side beams 22, 23 are made of L-shaped steel sections. The bottom beam 21 has its opposite ends welded to one end of the side beam 22, 23 so that the bottom beam 21 is placed perpendicular to the side beams 22, 23. In addition, one face 21a of the bottom beam 21 is disposed within the same plane as those of respective faces 22a, 23a of the side beams 22, 23. Thereby aligning each lateral end of the metal forms being conveyed. The other end of the side beams 22, 23 is welded to an upper beam 24 parallel to the bottom beam 21. The upper beam 24, made of an L-shaped steel section, with an identical length to the bottom beam 21, is used to stiffen the side beams 22, 23.

The bottom beam 21 also comprises locking means 30, 31 adapted to engage an inner surface of each longitudinal end of the lowermost-placed metal form. Locking means 30, 31 are in the form of locking fingers removably fitted adjacent each end of the bottom beam 21 where the latter joins the side beams 22, 23. Since metal forms have normally U-shaped cross sections, placing its open side downwardly allows the locking means 30, 31 to be inserted through the bottom beam 21, giving the resulting clearance. Locking means 30, 31 are used to engage an interior surface of each longitudinal end of the lowest metal form to prevent slippage thereof. To meet such requirements, locking means 30, 31 should be long enough to engage an interior surface of the metal form, but smaller than the depth of the metal form to ensure a more positive retention. Although cylindrical-shaped locking means 30, 31 are shown, other shapes, such as square or plate-like fingers, may be used, so long as they are engageable with an interior surface of the metal form.

Similarly arranged locking means 30', 31' are provided adjacent the opposite ends of an upper surface of the bottom beam 24. When metal forms are desired to be moved in a stacked condition, locking means 30', 31' are used to retain the upper tier of metal forms whether such forms are of identical or different length than the lower tier.

In addition, a hooking beam 25, which is made of an L-shaped steel section, has one face welded to the bottom and upper beams 21, 24 parallel to side beams 22, 23, so that the welded face serves to strengthen the whole pallet means. The hooking beam 25 also has a cutout 26 formed on an upper end of the other face thereof and adpated to received a lifting hook connected to a wire rope Thus, the pallet means of the present invention has a lightweight design, weighing about a tenth the weight of conventional container means, for each member of the pair.

Figure 6:
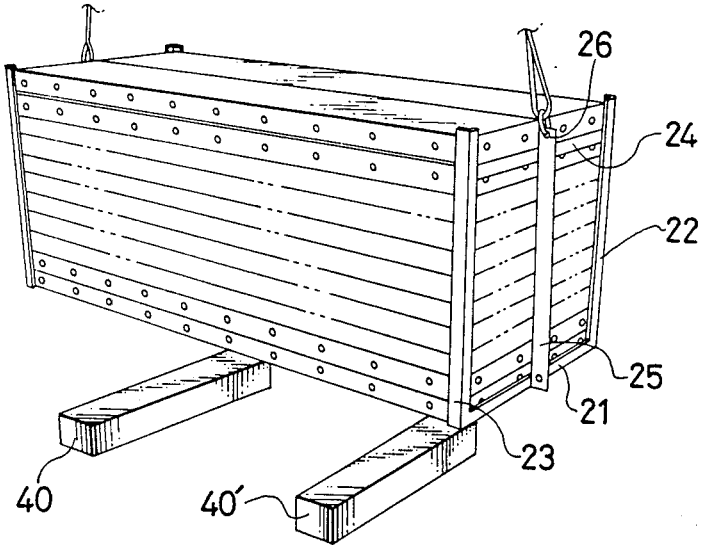
FIG. 6 is a perspective view to help explain the operation of the pallet means of one embodiment of the present invention.

Next, by reference to FIG. 6, the operation of the pallet means will be explained.

Two square timbers 40, 40' are first placed in appropriate positions, on top of which metal forms are piled one above another, say, in two rows within a size defined by the upper beam 24, bottom beam 21 and side beams 22, 23. Two square timbers 40, 40' are used to provide a spacing between the opposite longitudinal ends of metal forms and the ground, thereby allowing insertion of locking means 30, 31 for engaging the interior surface of the lowest metal form at each corner. Locking means 30, 31 are then inserted in place to engage the lowest metal form, while the pallet means are mounted on the metal forms so that the opposite lateral ends of the metal forms are covered by side beams 22, 23. If desired, an upper tier of metal forms may be placed to engage the locking means 30', 31'. A combination of metal forms with the pallet means attached thereto are now ready for transport by fastening wire ropes through slots 26, 26 on the hooking beams 25, 25. Upon lifting by a crane, as shown in FIG. 6, hooking slots 26, 26 are pulled inwardly by wire ropes. An angular moment occurs in the hooking beams 25, 25, with the uppermost-placed metal form and the upper beam 24 serving as the fulcrum, thereby forcing the lower end of respective hooking beams 25, 25, and hence the bottom beams 21, 21, to be separated away from the metal forms. Simultaneously, locking means 30, 31 are more intensively forced against the interior surface of the lowest metal form at each longitudinal end, thus enhancing a safe and positive retention.

Upon arrival at a destination, the metal forms are preferably placed on top of two square timbers, as is done before dispatch, to provide a spacing between the opposite ends of the metal form and the ground. Wire ropes are then untied from the hooking holes 26, 26, and the pallet means removed from the opposite lateral ends of the metal forms. Since the pallet means has no limitation in conveying or handling metal forms, this will contribute to a higher work efficiency.

It will be understood that the pallet means of this invention presents no obstacle in loading or unloading the metal forms therewith, thereby speeding up the transport and use of metal forms. In addition, the lightweight design of the pallet means allows mechanized handling of just a few metal forms, instead of the use of manpower, thereby enhancing efficiency of the whole concrete pouring work. A pair of pallet means are spaced apart from each other to hold metal forms therebetween, allowing various lengths of metal forms; the pallet means is deformation-free during transport, leading to a prolonged life of the pallet; and the pallet means needs a minimum storage space when not in use.

I claim:

1. A pallet for transporting a pile of metal forms of the type having interior surfaces, the pallet having a pair of members spaced apart from each other and adpated to hold the opposite lateral ends of metal forms, each member of said pair respectively comprising:

a bottom beam for holding a lateral end of the bottom of said pile of metal forms;

the bottom beams of said pair mounted on each lateral end of said metal forms for retention thereof, wherein each bottom beam includes locking means connected thereto and upstanding therefrom such that the locking means engage an interior surface of said metal form at each longitudinal end.

* * * * *